US007293513B2

(12) United States Patent
Fluckiger et al.

(10) Patent No.: US 7,293,513 B2
(45) Date of Patent: Nov. 13, 2007

(54) DEVICE FOR SECURING THE UPPER THREAD LOOP AFTER THREADING

(75) Inventors: Hans Fluckiger, Oetwil am See (CH); Livio Selm, Berg (CH); Niklaus Wacker, Steckborn (CH)

(73) Assignee: Fritz Gegauf Aktiengesellschaft BERNINA-Nahmaschinenfabrik, Steckborn (CH)

( * ) Notice: Subject to any disclaimer, the term of this patent is extended or adjusted under 35 U.S.C. 154(b) by 0 days.

(21) Appl. No.: 11/425,590

(22) Filed: Jun. 21, 2006

(65) Prior Publication Data

US 2007/0017424 A1 Jan. 25, 2007

(30) Foreign Application Priority Data

Jul. 25, 2005 (CH) ..... 1248/05

(51) Int. Cl.
*D05B 87/02* (2006.01)
*D05B 55/00* (2006.01)

(52) U.S. Cl. ..... 112/225

(58) Field of Classification Search ..... 112/220–227; 223/99

See application file for complete search history.

(56) References Cited

U.S. PATENT DOCUMENTS 2,530,768 A * 11/1950 Hickey ..... 112/225
5,143,005 A * 9/1992 Jimenez et al. ..... 112/225
5,615,629 A * 4/1997 Yamada et al. ..... 112/225
6,973,888 B2 * 12/2005 Yoshikazu ..... 112/225

* cited by examiner

*Primary Examiner*—Ismael Izaguirre
(74) *Attorney, Agent, or Firm*—Volpe and Koenig, P.C.

(57) ABSTRACT

A device (1) with a wire holder (13) for securing the upper thread loop (25) after the threading of the upper thread (23) through the eye (5) of a sewing machine needle (3) is provided. The wire holder deflects a progression of the two thread legs of the thread loop (25) upwards and thus securely holds the upper thread (23) in a hook chamfer at the hook (7).

5 Claims, 7 Drawing Sheets

DEVICE FOR SECURING THE UPPER THREAD LOOP AFTER THREADING

BACKGROUND

The invention is related to a device for securing the upper thread loop after threading the upper thread into the eye of a sewing machine needle.

For decades, manually operated or fully automatically operating threading devices have been known for threading the upper thread of a sewing machine through the eye of the sewing needle. For threading, the upper thread is caught via a threading or catching hook, which is guided through the eye of the needle, and a loop is formed behind the eye of the needle. This thread loop can later be grabbed manually and the loose end can be pulled through the eye. This manipulation latently bears the risk that, when grabbing the loop extending through the eye of the needle, it can be pulled back out of the eye of the needle due to the fact that it is relatively short or due to a movement of the take-up lever, and thus the threading process has to be repeated.

In order to prevent this, a threading device is known from U.S. Pat. No. 5,615,629, in which the thread located in the threading or catching hook is held by a wire holder in a clamped manner. Here, the upper thread is pressed by the wire holder into the chamfer of the hook. In order to allow the thread loop to be released for the sewing process, the wire holder with a link is guided out of the hook when the threading device is raised, subsequently allowing the thread loop to drop off the catching hook.

SUMMARY

An object of the present invention is to provide a safely operating device, designed in a technically simple construction, for securing the upper thread loop after its formation by the threading hook.

This object is attained by a device having the features of the invention. Advantageous embodiments of the device are described in detail below.

The invention provides a wire holder, mounted at the support or pivoting device for the threading hook, which can secure the thread loop during its formation by the threading hook without the help of any link, i.e. prevent the thread loop from being dropped prior to its complete formation. After the threading process and the upward motion of the threading hook the wire holder is located outside the sewing area and is protected from damage in spite of its filigree construction.

BRIEF DESCRIPTION OF THE DRAWINGS

The invention is explained in greater detail on the basis of a preferred embodiment of the invention as shown in the drawings. Show are.

DETAILED DESCRIPTION OF THE PREFERRED EMBODIMENTS

Figure 1:
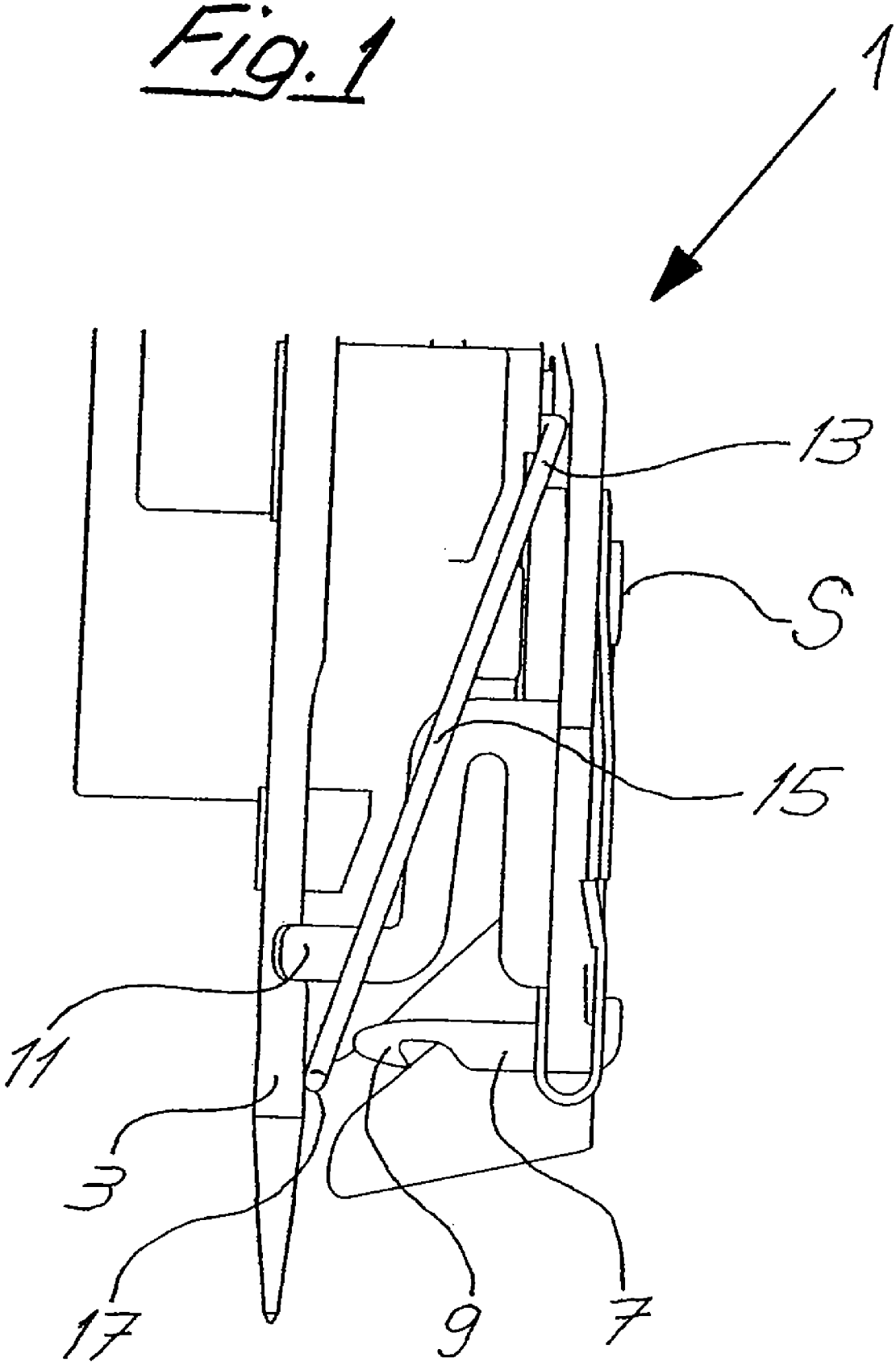
FIG. 1 is a vertical cross-sectional view through the pivoting device with the threading hook immediately before beginning the threading process.
Figure 2:
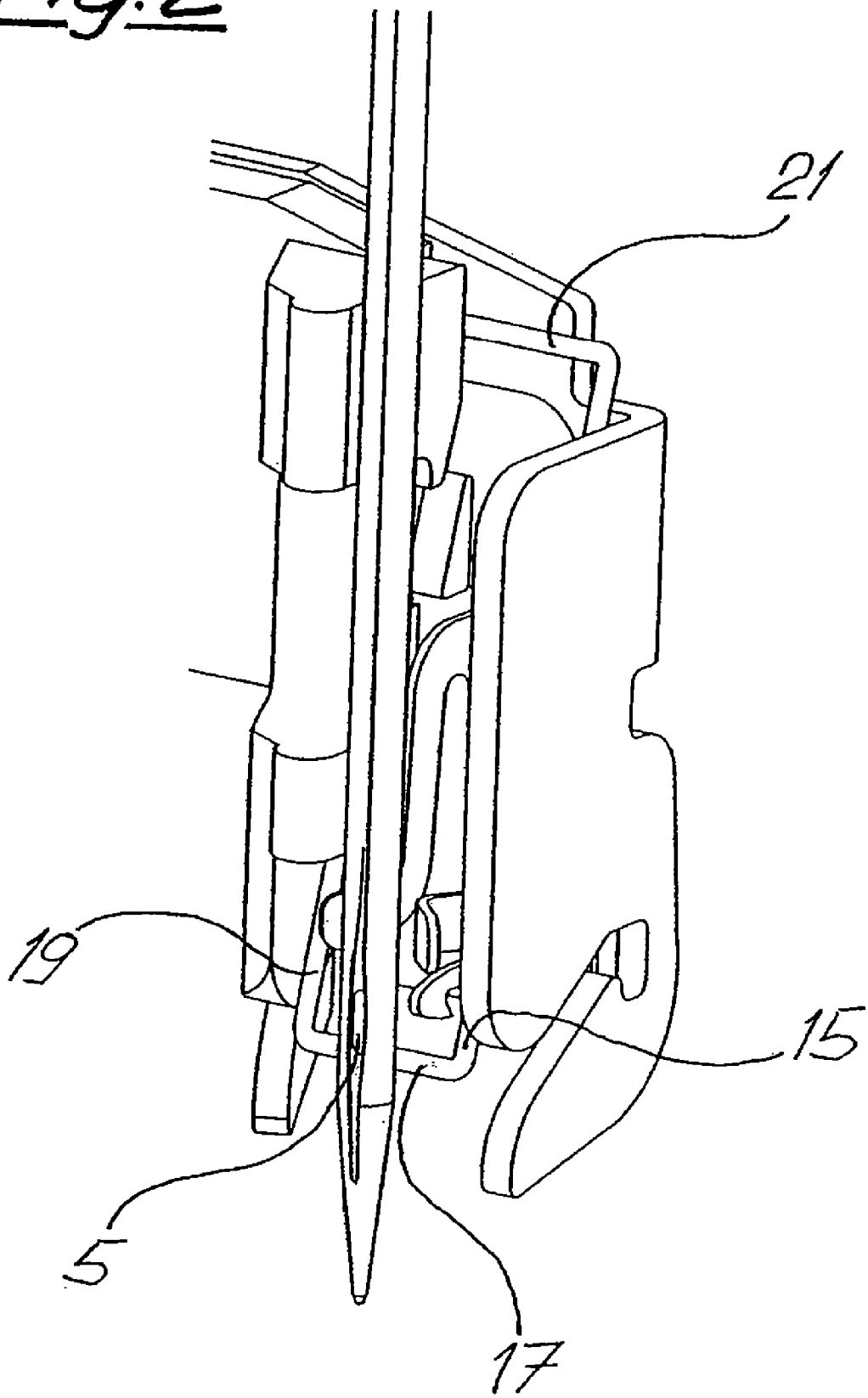
FIG. 2 is a perspective view of the threading device and the needle immediately before the threading process.
Figure 3:
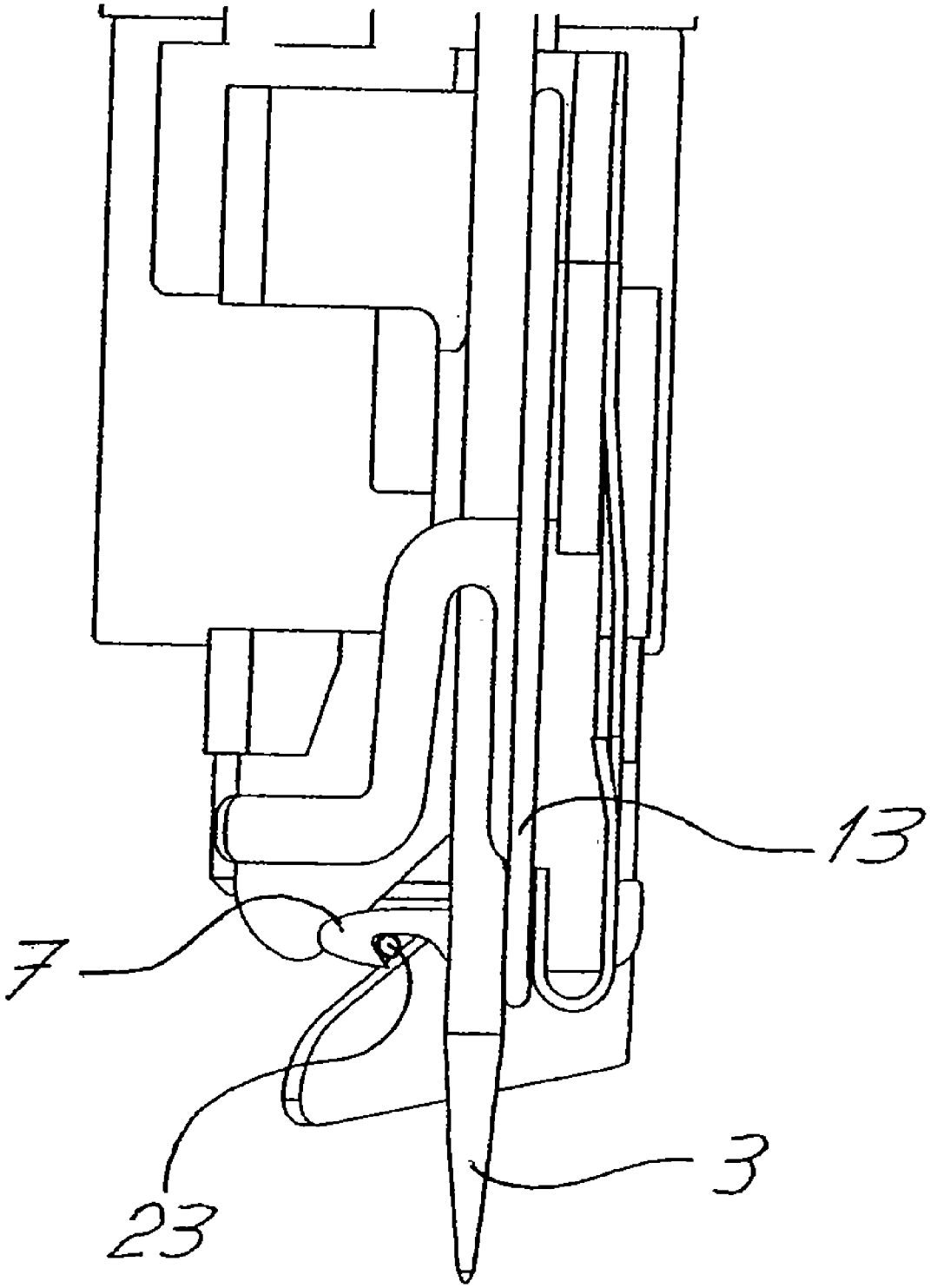
FIG. 3 is a vertical cross-sectional view through the pivoting device with the threading hook after having caught the upper thread.
Figure 4:
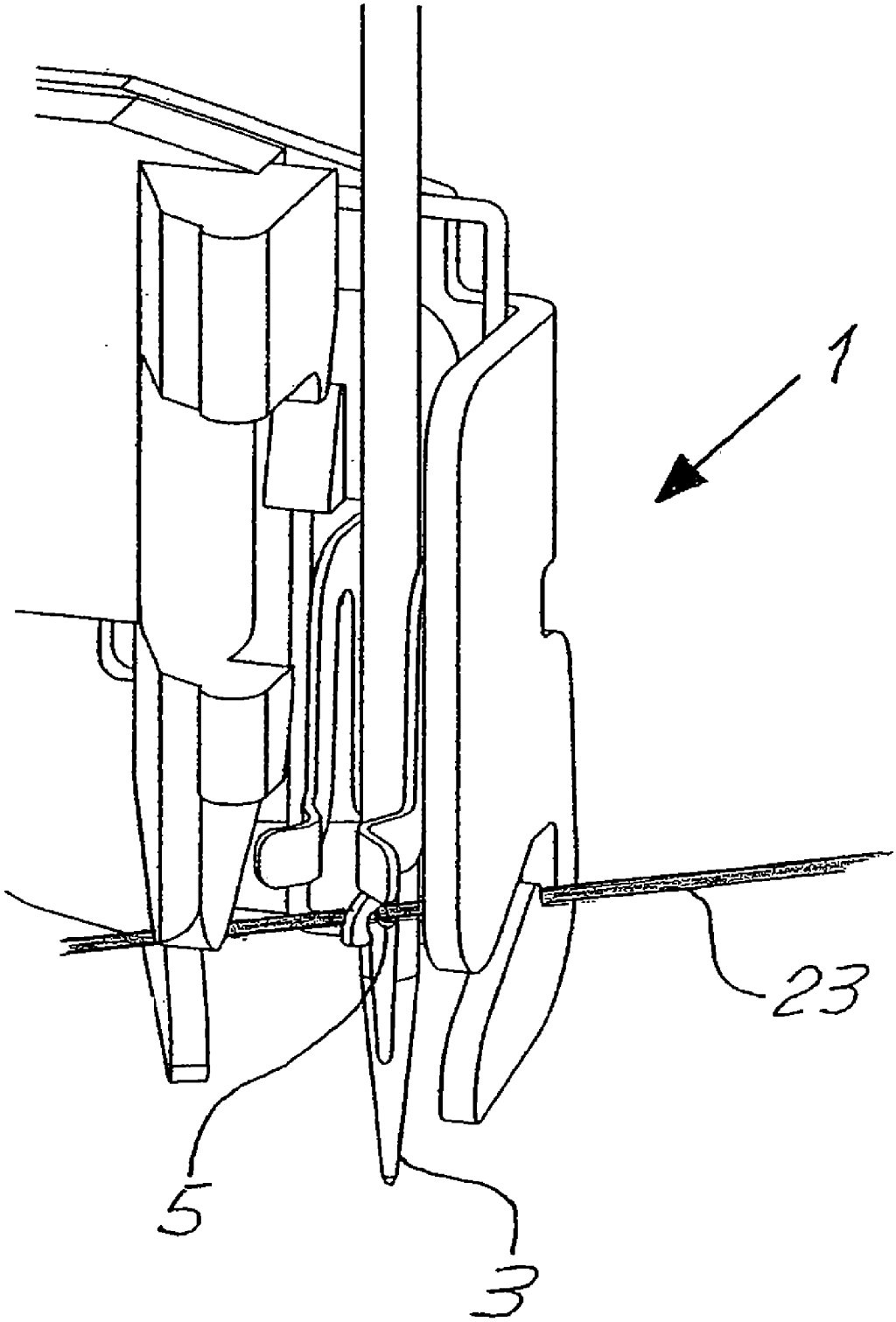
FIG. 4 is a perspective view of the threading device and the needle after having caught the upper thread.
Figure 5:
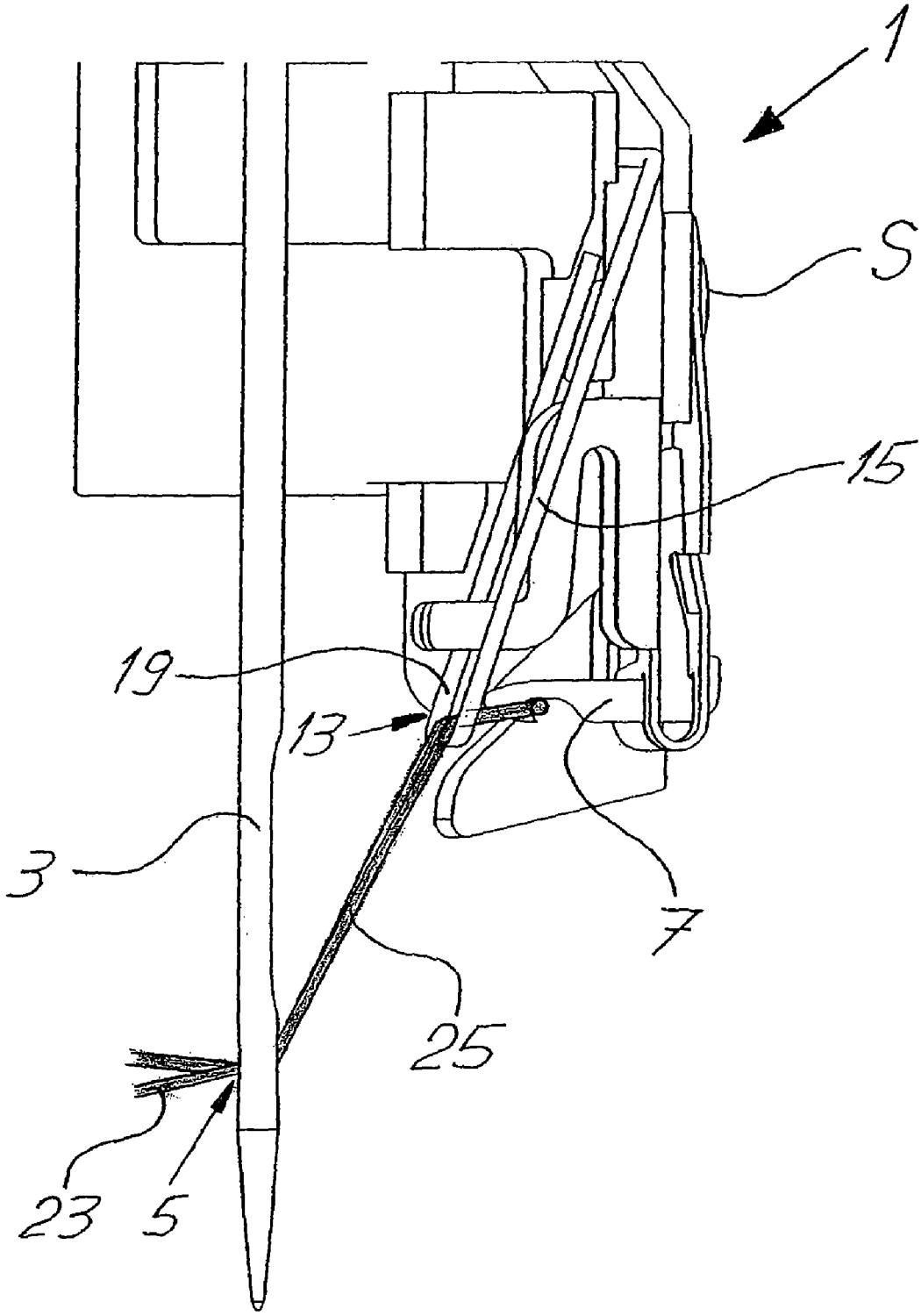
FIG. 5 is a vertical cross-sectional view through the threading device with an extended upper thread loop.

Reference character 1 relates to a support and pivoting device 1. The device is held in the upper arm of a sewing machine, not shown, pivotal around a vertical pivotal axis. The pivoting device 1 is additionally supported such that it can be displaced in the vertical direction according to FIGS. 1 through 4 from a raised resting position into a lowered threading position. Further, in these figures, a needle marked with the reference character 3 is shown having an eye of the needle, eye 5 for short. The needle 3 is shown in the raised position, i.e. the needle 3 is not piercing the article to be sewn (not shown). A threading hook, hook 7 for short, is mounted at the pivoting device 1. In the threading position, its front end 9 with the hook chamfer 10 forming the hook 7 (FIG. 7*a*) is located at the same height as the eye 5. Above the hook 7, a positioning device 11 is shown above the hook 7, which, guided by the needle 3, also positions the hook 7 in the lateral direction precisely in front of the eye 5, regardless of the needle thickness or the fact if the needle 3 is perfectly straight or slightly bent. In the exemplary embodiment described, the hook 7 and the positioning device 11 are connected to the pivoting device 1, oscillating around a pivotal axis S.

Further, a wire holder 13 is mounted to the pivoting device 1, which comprises a longitudinal leg 15 extending diagonally downwards and an adjacent foot flange 17 extending perpendicular to the needle 3. In the embodiment shown, a second longitudinal leg 19 is positioned parallel to the first longitudinal leg 15 and adjacent to the foot flange 17. The first longitudinal leg 15 may comprise an angled connection or mounting leg 21 at its upper end, by which the wire holder 13 can be connected to the pivoting device 1. Alternatively, the wire holder 13 and/or the foot flange 17 can also be mounted laterally to the threading hook 7. The type of mounting of the wire holder 13 to the pivoting device 1 can vary. It may occur by welding, gluing, clamping, or any other connecting means. The distance of the two longitudinal legs 15, 19 and/or the horizontal extension of the foot flange 17 is preferably greater than twice the diameter of the needle 3.

In the following, the functionality of the device is explained in greater detail. After lowering the support and pivoting device 1 into the threading position, in which the hook 7 is aligned precisely in front of the eye 5 of the needle 3 (cf. FIGS. 1 and 2), the foot flange 17 contacts the needle 3 in proximity to the eye 5. During the subsequent guidance of the hook 7 through the eye 5 of the needle 3, the wire holder 13 and/or its foot flange 17 is pivoted towards the rear and downwards, away from the front end 9 of the hook and below the hook 7. Here, the foot flange 17 always remains elastically in contact with the needle 3. After having caught the upper thread 23, which has been positioned by suitable means, not shown in the figures, in front of the eye 5 of the needle 3 below the hook 7, the hook 7 returns by the pivotal motion of the support and pivoting device 1 with the thread 23 to the original position according to FIGS. 1 and 2 and forms a thread loop 25, after another pivotal motion and a simultaneous axial raising of the support and pivoting device 1, the loop leading from the eye 5 in the needle 3 diagonally upwards to the hook 7. The wire holder 13, also guided away from the needle 3 during the pivoting of the support and pivoting device 1, supports the two legs of the thread loop 25 at a distance from the front end 9 of the hook 7 and in this manner prevents the thread loop 25 from slipping out of the hook 7 without clamping the thread 23. The upper thread 23 is prevented from slipping out of the hook 7 after the formation of the loop in that the wire holder 13 and/or its foot flange 17 with the two legs 23*a*, 23*b* of the thread loop 25 is lifted upward in reference to the hook 7, and thus the angle between the thread loop 25 and the hook 7 is reduced significantly. The thread loop 25 between the foot flange 17 and the hook chamfer 10 extends almost horizontally.

Figure 6:
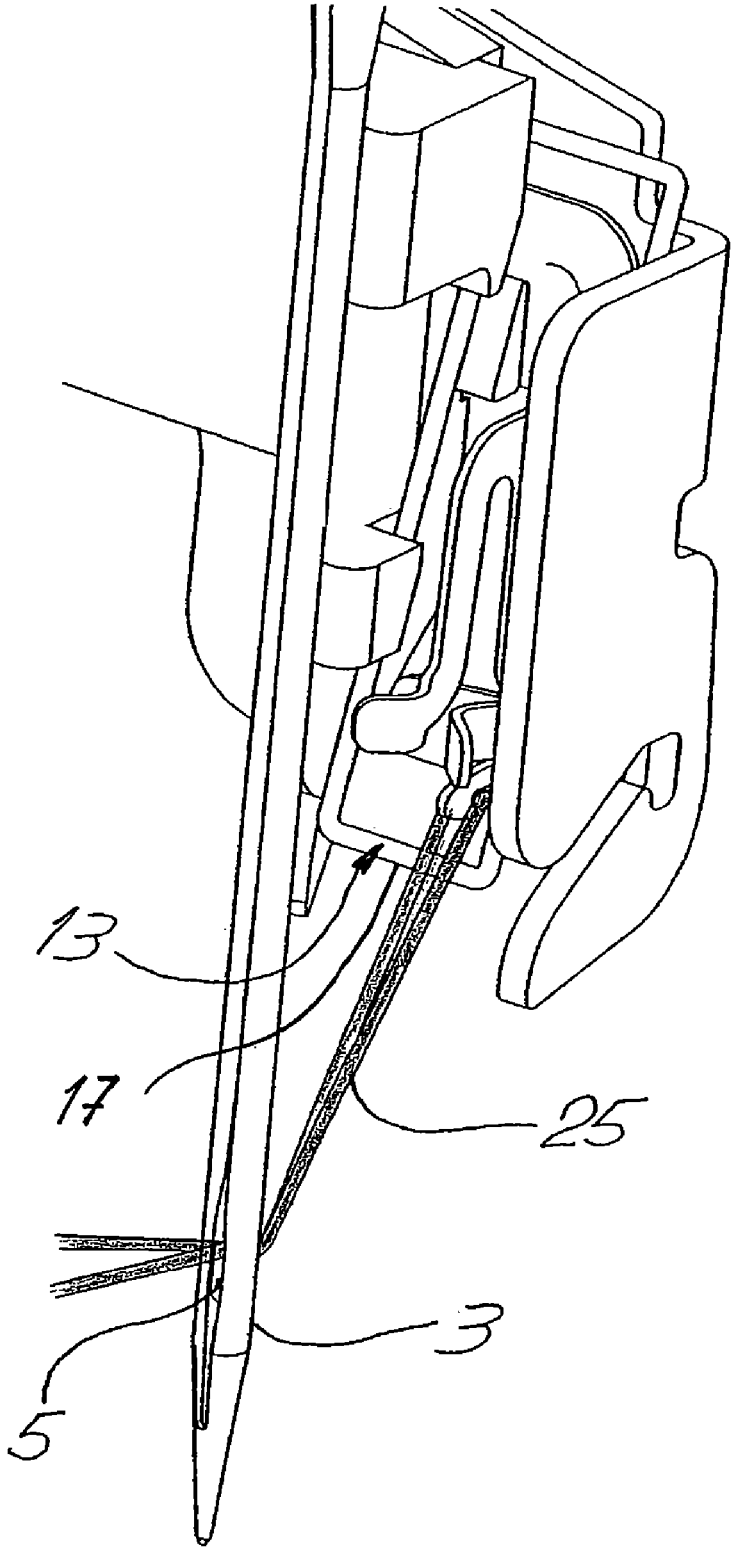
FIG. 6 is a perspective representation of the threading device with an extended upper thread loop.

As soon as the support and pivoting device 1 with the thread loop 25 hanging therefrom is displaced further upwards towards the resting position (cf. FIG. 6), the thread loop 25 may pivot the wire holder 13 downwards and backwards with raising tension and the thread loop 25, sufficiently long, can fall out of the hook 7.

When the tension is too low, the thread loop 25 remains hanging from the hook 7 until the resting position is reached. The thread loop 25 can now be pulled off the hook 7 by two fingers or it can be sewn directly without the thread loop 25 manually being pulled off the hook 7. When the end of the thread 23*b* is very short prior to the thread 23 being inserted into the hook 7 or if it has been cut very short, the thread loop 25 can be pulled out of the threading device 25 when it is raised. Usually the end of the thread 23*b* remains hanging from the hook 7 in spite thereof and it can directly be sewn.

In the FIGS. 7*a* through 7*d*, the progression of the threading process is shown schematically once more.

Figure 7A:
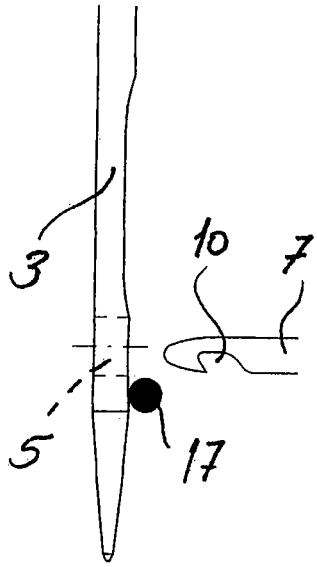
FIGS. 7*a* through 7*d* are views illustrating four consecutive hook positions during the threading of the upper thread.
Figure 7B:
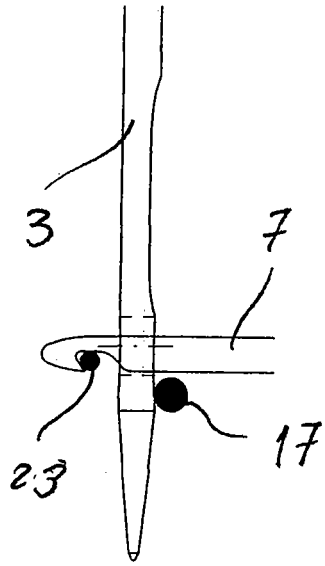
Figure 7C:
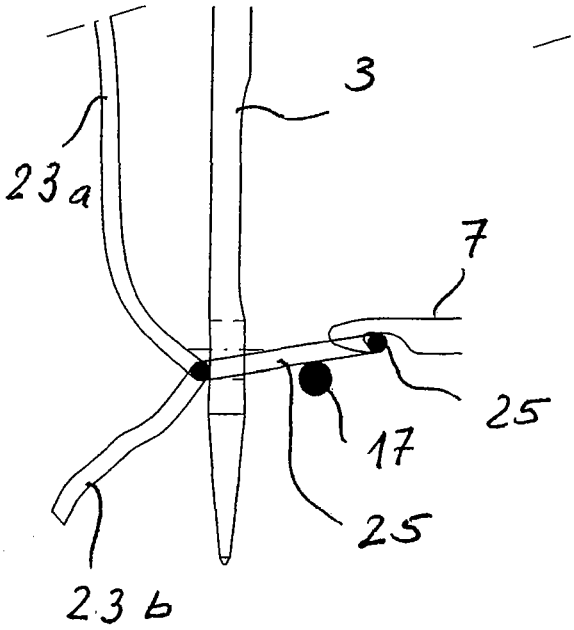
Figure 7D:
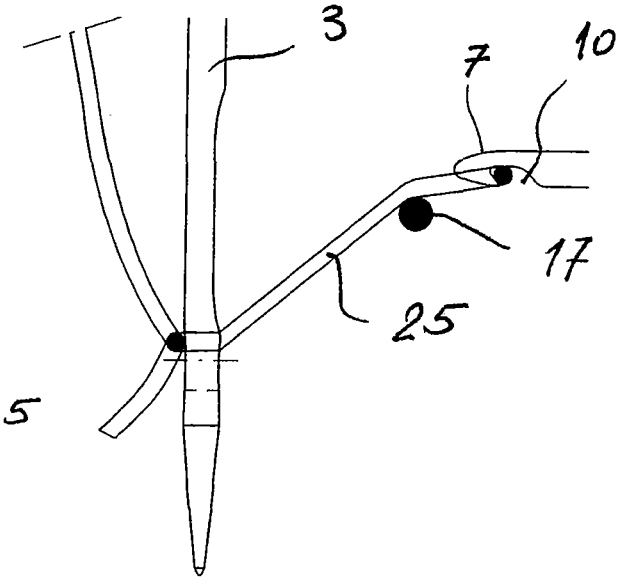

In FIG. 7*a*, the hook 7 is distanced from the eye 5. The foot flange 17 of the wire holder 13 (the latter being omitted in the FIGS. 7*a* through 7*d* for reasons of better visibility) moving on a curved path is already contacting the needle 3 in a slightly elastic fashion. When entering and penetrating the hook 7 through the eye 5, the foot flange 17 is held back by the needle 3, it essentially remains stable at the location (FIG. 7*b*) shown in FIG. 7*a*. The upper thread 23 already contacts the hook chamfer 10. It can be inserted manually or be fed thereto by another suitable means. In FIG. 7*c*, the threading hook 7 is moved back through the eye 5 and the thread 23 is pulled back through the eye 5 in the form of a thread loop 25. The foot flange 17 has separated during the return movement of the hook 7 from the needle 3 and now supports the thread loop 25 from below. When raising the support and pivoting device 1 (not shown in the FIGS. 7*a* through 7*d*), the foot flange 17 also moves upward and supports the thread loop 25 such that it initially cannot fall out of the hook chamfer 10. The latter does not occur until the end of the upward motion of the support and pivoting device 1, before it enters its resting position.

LIST OF REFERENCE CHARACTERS

1 support and pivoting device
3 needle
5 eye of the needle
7 hook
9 front end of 7
10 hook chamfer
11 positioning device
13 wire holder
15 first longitudinal leg
17 foot flange
19 second longitudinal leg
21 connection and mounting leg
23 upper thread
25 thread loop

The invention claimed is:

1. A device for securing an upper thread loop (25) after threading of an upper thread (23) into an eye (5) of a sewing machine needle (3), comprising a wire holder (13) mounted at a support and pivoting device (1) for a threading hook (7), which comprises a foot flange (17) extending approximately perpendicular to the needle (3), the wire holder (13) is provided such that the foot flange (17) is located behind the needle on a same side as the threading hook and is always positioned at a distance from the threading hook (7) prior to, during, and after the threading.

2. A device for securing an upper thread loop (25) after threading of an upper thread (23) into an eye (5) of a sewing machine needle (3), comprising a wire holder (13) mounted at a support and pivoting device (1) for a threading hook (7), which comprises a foot flange (17) extending approximately perpendicular to the needle (3), the wire holder (13) is provided such that the foot flange (17) is always positioned at a distance from the threading hook (7) prior to, during, and after the threading, wherein the foot flange (17) is pivotally arranged at a distance for movement in a curved path around a front end (9) of the threading hook (7).

3. A device according to claim 1, characterized in that the wire holder (13) is mounted above or lateral to the threading hook (7).

4. A device according to claim 3, wherein the foot flange 17 of the wire holder (13) is positioned in front of a hook chamfer (10) of the threading hook (7) in a resting position thereof and after formation of the upper thread loop (25).

5. A device according to claim 1, wherein the foot flange (17) is held by the wire holder (13) unilaterally or on both sides.

* * * * *